US005531571A

United States Patent [19]

Van Dyck

[11] Patent Number: 5,531,571

[45] Date of Patent: Jul. 2, 1996

[54] REGULATING DEVICE WITH STARTING AND STOPPING DEVICE FOR SCREW-TYPE COMPRESSORS, AND STARTING AND STOPPING DEVICE USED HEREBY

[75] Inventor: Christiaan Van Dyck, Lier, Belgium

[73] Assignee: Atlas Copco Airpower, naamloze vennootschap, Wilrijk, Belgium

[21] Appl. No.: 227,378

[22] Filed: Apr. 14, 1994

[30] Foreign Application Priority Data

Jun. 16, 1993 [BE] Belgium ..... 09300612

[51] Int. Cl.[6] ..... F04B 49/06

[52] U.S. Cl. ..... 417/45; 417/282; 137/542

[58] Field of Search ..... 417/45, 282; 137/542

[56] References Cited

U.S. PATENT DOCUMENTS

| | | | |
|---|---|---|---|
| 3,207,172 | 9/1965 | Steer et al. | 137/542 |
| 3,367,562 | 2/1968 | Persson et al. . | |
| 3,727,636 | 4/1973 | Simmons | 137/542 |
| 3,778,192 | 12/1973 | Caffrey | 417/286 |
| 3,961,862 | 6/1976 | Edstrom et al. | 417/282 |
| 4,149,827 | 4/1979 | Hofmann, Jr. | 417/12 |
| 4,171,188 | 10/1979 | Anderson et al. | 417/282 |
| 4,664,601 | 5/1987 | Uchida et al. | 417/45 |
| 4,738,118 | 4/1988 | Kanazawa | 417/45 |
| 4,765,364 | 8/1988 | Arcari | 137/542 |
| 4,959,969 | 10/1990 | Okamoto et al. | 417/45 |
| 5,008,297 | 2/1992 | Maruyama et al. | 417/45 |

FOREIGN PATENT DOCUMENTS

| | | | |
|---|---|---|---|
| 1189865 | 3/1965 | Germany | 417/45 |
| 0244576 | 4/1987 | Germany | 417/45 |
| 0043281 | 3/1980 | Japan | 417/45 |

*Primary Examiner*—Richard A. Bertsch
*Assistant Examiner*—Xuan M. Thai
*Attorney, Agent, or Firm*—Bacon & Thomas

[57] ABSTRACT

A regulating device for screw-type compressors, which contain a compressor dement (1), an electrical motor (2) to drive the compressor element (1), a minimum pressure valve (4) which is mounted on the outlet (5) of the compressor element (1) and a vessel (6) which is mounted between the compressor element (1) and the minimum pressure valve (4), includes a controller which causes the motor (2) to turn at a frequency-regulated rotational speed at an almost constant pressure in the vessel (6), and a non-return valve (12) which is mounted on the inlet (10) of the compressor element (1) to aid in starting and stopping the motor.

6 Claims, 2 Drawing Sheets

1
2
3
4
5
6
7
8
9
10
11
12
25
26
27
F2
M
M

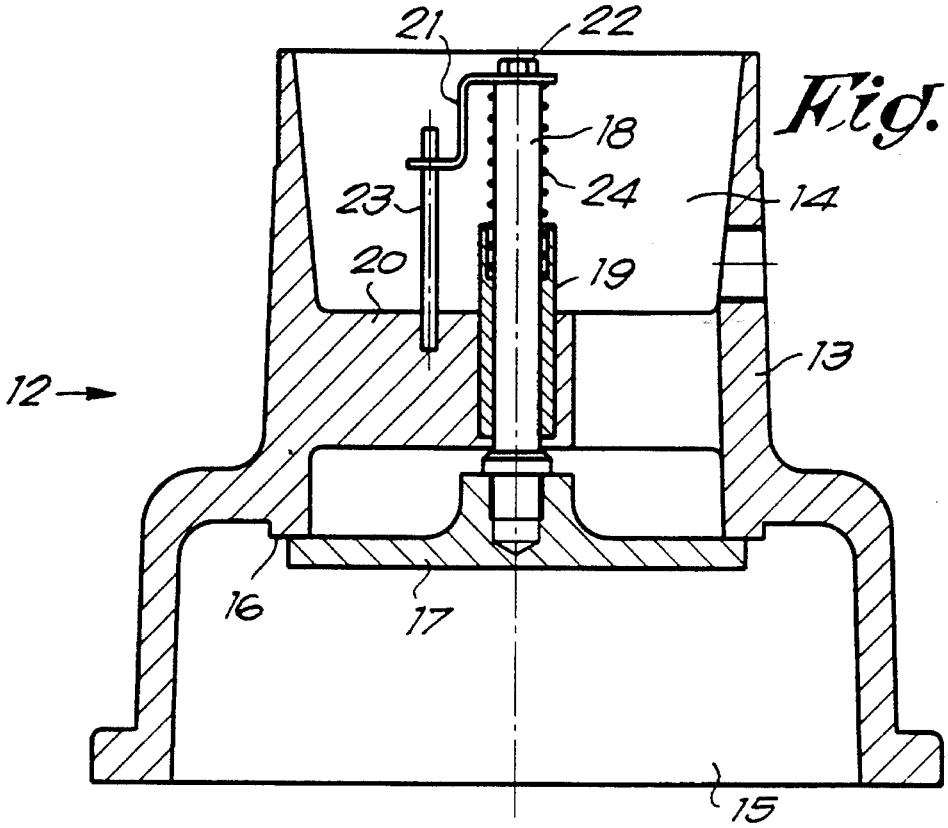
Fig. 2
Fig. 3
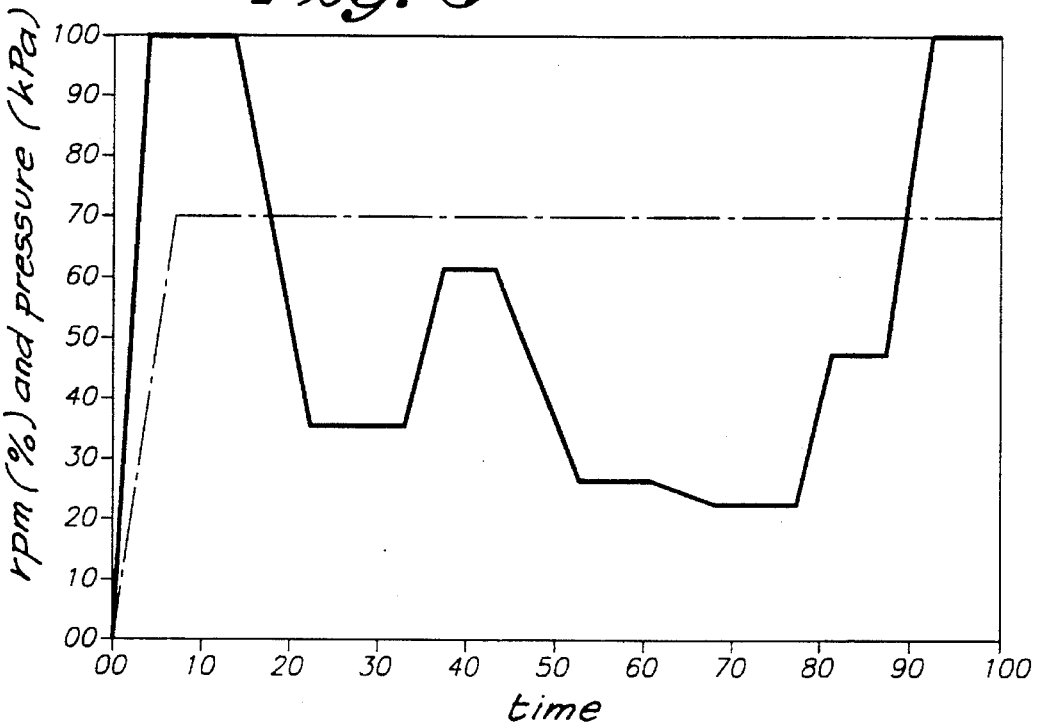

REGULATING DEVICE WITH STARTING AND STOPPING DEVICE FOR SCREW-TYPE COMPRESSORS, AND STARTING AND STOPPING DEVICE USED HEREBY

BACKGROUND OF THE INVENTION

1. Field of the Invention

The invention concerns a regulating device including a starting and stopping assisting arrangement for screw-type compressors which contain a compressor element, a minimum pressure valve which is mounted on the outlet of the compressor element and a vessel which is mounted between the compressor element and the minimum pressure valve, which regulating device contains means to control the motor.

2. Discussion of the Prior Art

The oil-injected screw-type compressors have been equipped until now with a regulating device provided with a starting and stopping aid which contains means to release the volume, after the compressor has come to a standstill and thus at zero rotational speed, which is situated between the outlet of the compressor element and the minimum pressure valve, in the atmosphere and which contains a relief valve which makes sure that the compressor element can further run idly, i.e. at a minimum pressure of about 0.5 to 1 bar which is sufficient to guarantee the oil injection, but whereby a minimum amount of air is drawn in.

With such a starting and stopping aiding arrangement, the succession of loaded and idle periods of the compressor provides a possible compressor regulation, and the means to control the motor are means which make the motor turn at an almost constant rotational speed, whereas the pressure in the vessel varies. Every loaded period, with maximum vessel pressure, is hereby followed by either an idle period with minimum pressure in the vessel sufficient to guarantee the oil injection in the compressor, or by a stop period with full blasting off of the vessel.

The blasting off of the volume between the outlet of the compressor element and the minimum pressure valve, until the pressure there becomes equal to the ambient pressure, is necessary with these known regulating devices to avoid very high current peaks when restarting. Indeed, given the output, the motor of the compressor is started with a starting current restriction, normally a star/D switch, to avoid current peaks. As a result, however, also the supplied motor torque drops, which becomes insufficient to start the compressor without blasting off the pressure at the outlet.

The blasting off results in a loss of energy, however, since compressed air is lost without being efficiently used. The blasting off produces a noise which must be possibly muffled, whereas the blast-off air must be blown off. Moreover, the means to blow off the air through the opening and closing of valves and air valves have quite a complicated construction.

The relief valve is necessary to restrict the number of starting and stop frequencies. With a star/D start, the number of starts and stops is limited to some fifteen per hour, as the motor would otherwise heat up too much.

Also this relief valve causes a loss of energy, since, also when the compressor, instead of stopping, turns on idly and does not produce any output, the motor still absorbs up to one fourth if its nominal output.

SUMMARY OF THE INVENTION

The invention aims to remedy these disadvantages and to provide a regulating device with an arrangement for aiding in the starting and stopping of screw-type compressors, which has a simpler construction and causes less or no loss of energy.

This aim is realized according to the invention in that the motor is controlled to turn at a frequency-regulated rotational speed at an almost constant pressure in the vessel, and in that to aid in starting and stopping the motor, a non-return valve is mounted on the inlet of the compressor element.

Thanks to the drive with a frequency-regulated rotational speed, it is possible to make the compressor start without any current peaks or peak torques, even against the pressure. As a result, the blasting off of the vessel is not necessary. After the initial filling under pressure of the vessel, its pressure remains almost constant, with no regard to whether the compressor element is turning or not.

BRIEF DESCRIPTION OF THE DRAWINGS

In order to better explain the characteristics of the invention, the following preferred embodiment of a regulating device for screw-type compressors, and of a starting and stopping device used hereby, according to the invention, is described as an example only without being limitative in any way, with reference to the accompanying drawings, where:

FIG. 2 shows a cross-section of a non-return valve indicated by F2 in FIG. 1; and FIG. 3 shows a diagram of the rotational speed of the motor and the pressure in the vessel as a function of time.

DETAILED DESCRIPTION OF A PREFERRED EMBODIMENT

Figure 1:
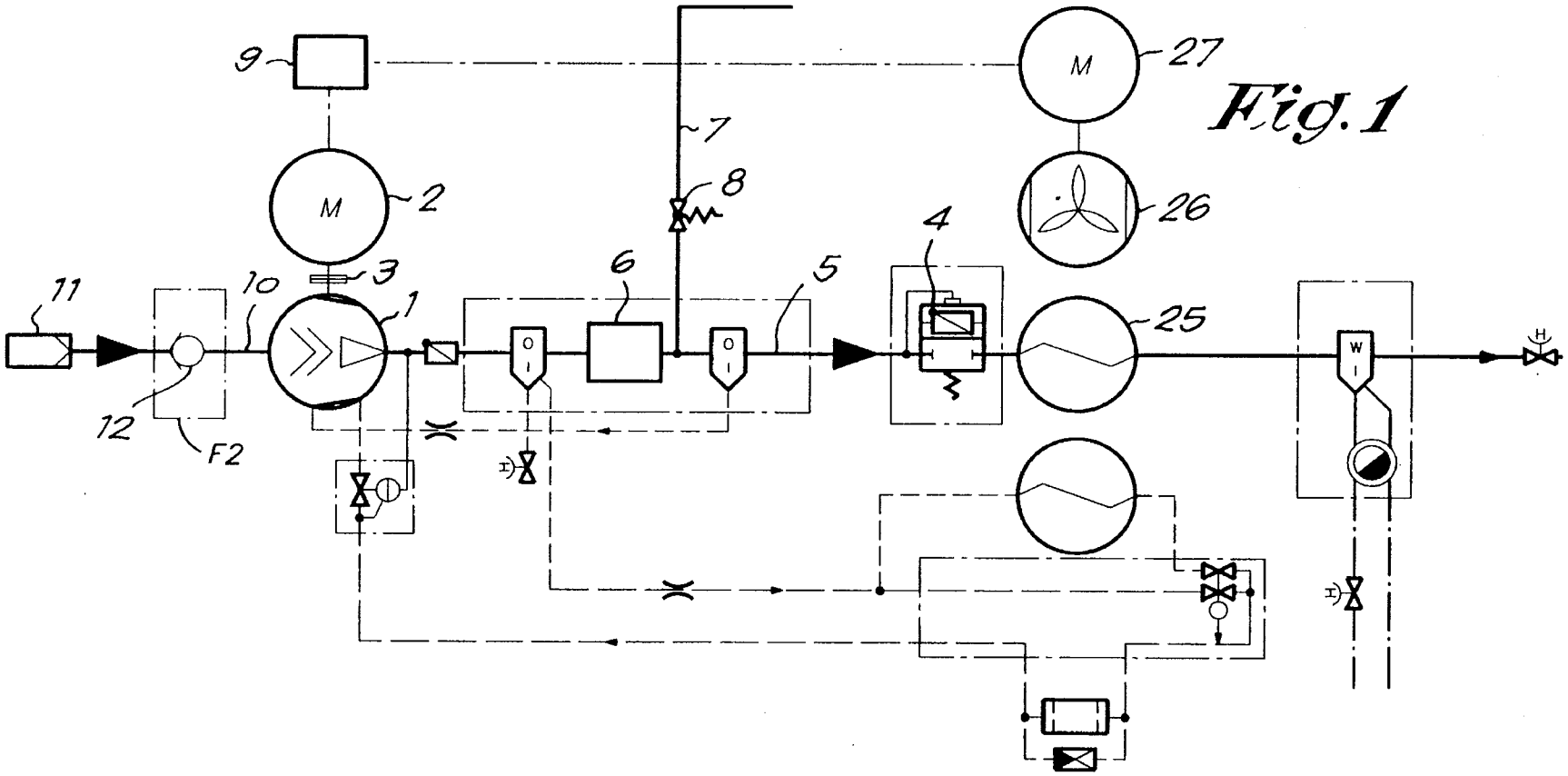
FIG. 1 is a schematic representation of a compressor provided with a regulating device according to the invention.

The screw-type compressor represented in FIG. 1 mainly contains a compressor element 1, an electric induction motor 2 with frequency-regulated revolutionary speed, which drives the compressor element 1 by means of a coupling 3, a minimum pressure valve 4 mounted on the outlet 5 of the compressor element 1 and a vessel 6 which is mounted in the outlet 5, between the compressor element 1 and the minimum pressure valve 4.

On the outlet 5 is connected a pipe 7 downstream of the vessel 6 in which is mounted a safety valve 8.

The revolutionary speed of the motor 2 is regulated by means of frequency control via a control 9. This control 9 contains a microprocessor-controlled frequency transformer with a fully controlled bridge rectifier, a direct current voltage interstage circuit with capacitor bank, and a pulse width modulation transformer with transistors. The materials used for the motor 2 and its actual construction are selected such that the iron and copper losses are restricted to a minimum. Very important hereby are the losses caused by eddy currents, since these losses are in proportion to the squared frequency.

The compressor element 1 draws in air via an inlet 10 in which is mounted an air filter 11, and between the air filter 11 and the compressor element 1 is mounted a non-return valve 12.

As represented in detail in FIG. 2, non-return valve 12 contains a housing 13, which forms a passage with a narrow part 14 which joins the air filter 11, and a wider part 15 which joins the compressor element 1. At the height of the transition from the wider part 15 to the narrow part 14, the housing 13 forms a seating 16 for a valve 17 which is mounted on a valve rod 18 which extends centrally in the narrow part 14. Said valve rod 18 can be shifted through bush 19 which is mounted in an edge 20 of the housing 13 protruding inwardly in the part 14.

At the free end of the valve rod 18 is fixed a hook 21 by means of a bolt 22. Hook 21 can be shifted with its end over a guiding pin 23 which is directed parallel to the valve rod 18 and is fixed in the edge 20 next to the bush 19. The guiding pin 23 makes sure that the valve rod 18 and the valve 17 cannot rotate when opened. Between bush 19 and the hook 21, the valve rod 18 is surrounded by a spiral spring 24 which pushes the valve 17 in its closed position via the valve rod 18.

In the wall of the part 14 is provided an opening 28 to connect the measuring appliances.

Downstream of the minimum pressure valve 4 is mounted a cooler 25 on the outlet 5 of the compressor to cool off the compressed air. This cooler works in conjunction with a fan 26 which is driven by an electrical motor 27.

The minimum pressure valve 4 is mounted on the outlet of the vessel 6 and opens the outlet 5 as soon as the pressure in the vessel exceeds a certain value, for example 4 bar. This valve 4 also functions as a non-return valve which, when the compressor element 1 is stopped and thus when the output is zero, immediately closes off the outlet 5 and prevents air from streaming from the compressed air net situated behind the compressor. Such minimum pressure valves are already known and contain for example a sealing washer which is attached on a first plunger which can be moved against the action of a spring in a larger plunger which, when pressure rises, against the action of a second spring, is pushed away by the sealing washer when the abovementioned minimum pressure is reached.

The regulating device consisting of the control 9 and the non-return valve 12 works as follows.

When the compressor is started, an underpressure is created in the part 15 of the non-return valve 12. When a certain value has been reached, the force exerted by this underpressure on the valve 17 exceeds the prestress which the spring 24 has in the opposite sense. As a result, the valve 17 is lifted from the seating 16, and the compressor element 1 can draw in the full flow. The valve 17 opens entirely until the hook 21 is situated against the bush 19.

The minimum pressure valve 4 closes off the outlet 5 until the pressure in the vessel 6 has risen up to a certain minimum value.

When the compressor element 1 stops, the above-mentioned underpressure in the non-return valve 12 falls out, and the spring 24 will close the valve 17 before air or oil can escape from the compressor element 1. Also the minimum pressure valve 4 immediately closes off the outlet of the vessel 6, as already mentioned.

Between the starting and stopping, the control 9 provides for a variable rotational speed of the motor 2 with a constant pressure in the vessel 6. The induction motor 2 is provided with a variable tension and a variable frequency as a function of the required revolutionary speed, which revolutionary speed is transmitted to the frequency transformer by an electronic control unit which is integrated in the compressor and which does not only control the frequency transformer, but also provides for the pressure regulation of the compressor. The control 9 makes sure that the tension and the frequency of the motor 2 are such that the torque on the shaft of the motor 2 is sufficient to drive the load.

FIG. 3 represents the fluctuation of the revolutionary speed as a percentage of the maximum revolutionary speed as a function of time, in a full line. The chain line represents the pressure in the vessel 6 as a function of this time. When starting up, this pressure very quickly rises to its maximum value, after which the pressure is maintained almost constant.

The above-described control device has a relatively simple construction. The starting and stopping aiding arrangement is restricted to a simple non-return valve 12 and thus has a relatively simple construction.

The present invention is by no means limited to the embodiment described above and represented in the accompanying drawings; on the contrary, such a regulating device with a starting and stopping assisting arrangement can be made in all sorts of variants while still remaining within the scope of the invention.

I claim:

1. In a screw-type compressor system including a compressor element driven by an electric motor, a minimum pressure valve mounted at an outlet of the compressor element and a vessel positioned between the compressor element and the minimum pressure valve, a regulating device comprising: means for controlling the motor to turn at a frequency-regulated rotational speed at a substantially constant pressure in the vessel; and means for aiding the starting and stopping of the compressor element, said aiding means being mounted at an inlet of the compressor element for completely closing said inlet upon starting and stopping of said compressor element.

2. The regulating device according to claim 1, wherein said aiding means comprises a non-return valve including a housing defining a seating therein, a valve rod shiftably mounted within said housing, a valve member mounted to the valve rod and a spring element surrounding said rod, said spring element acting against a part of said housing and biasing said valve member into a closed position wherein said valve member engages said seating.

3. In a screw-type compressor system including a compressor element driven by an electric motor, a minimum pressure valve mounted at an outlet of the compressor element and a vessel positioned between the compressor element and the minimum pressure valve, a regulating device comprising: means for controlling the motor to turn at a frequency-regulated rotational speed at a substantially constant pressure in the vessel; and means for aiding the starting and stopping of the compressor element, said aiding means being mounted at an inlet of the compressor element and comprises a non-return valve including a housing defining a seating therein, a valve rod shiftably mounted within said housing, a valve member mounted to the valve rod and a spring element surrounding said rod, said spring element acting against a part of said housing and biasing said valve member into a closed position wherein said valve member engages said seating, and wherein said aiding means further comprises an element mounted to an end of said valve rod remote from said valve member and a guiding pin carried by said housing and extending substantially parallel to said valve rod, said element being shiftably mounted upon said guiding pin, said element and said guiding pin cooperating to prevent rotation of said non-return valve upon shifting of said valve rod.

4. The regulating device according to claim 1, further comprising means for controlling the motor as a function of a desired revolutionary speed.

5. The regulating device according to claim 2, further comprising means for controlling the motor as a function of a desired revolutionary speed.

6. The regulating device according to claim 3, further comprising means for controlling the motor as a function of a desired revolutionary speed.

* * * * *